United States Patent [19]

Katz

[11] 4,432,401

[45] Feb. 21, 1984

[54] STABILIZER FOR THE CONTENTS OF FURNITURE DRAWERS DURING FURNITURE MOVING AND METHOD

[76] Inventor: Edward R. Katz, 4847 Cambridge Dr., Dunwoody, Ga. 30338

[21] Appl. No.: 399,444

[22] Filed: Jul. 19, 1982

[51] Int. Cl.[3] ..... B65B 1/04

[52] U.S. Cl. ..... 141/4; 312/352; 206/522; 410/119

[58] Field of Search ..... 141/1–4; 206/522; 312/183.1, 292, 352, 335 R, 237, 214; 410/117–119, 124, 125, 120, 121; 138/89–89.3; 248/500, 504

[56] References Cited

U.S. PATENT DOCUMENTS 2,907,580 10/1959 Tietig ..... 206/522

2,963,046 12/1960 Goodrich ..... 138/89.2

3,988,048 10/1976 Murray ..... 312/352

FOREIGN PATENT DOCUMENTS 2218759 10/1983 Fed. Rep. of Germany ..... 206/522

*Primary Examiner*—Stephen Marcus

*Assistant Examiner*—Kenneth S. Putnam

*Attorney, Agent, or Firm*—William H. Needle

[57] ABSTRACT

To eliminate the costly and laborious procedure of emptying the contents of furniture drawers and boxing the contents in the movement of furniture, an inflatable drawer contents stabilizer is placed in each drawer to prevent movement of the drawer contents when a desk or other drawer equipped furniture item is laid on its side or otherwise manipulated during transport.

3 Claims, 5 Drawing Figures

STABILIZER FOR THE CONTENTS OF FURNITURE DRAWERS DURING FURNITURE MOVING AND METHOD

BACKGROUND OF THE INVENTION

The broad objective of this invention is to eliminate one of the major inefficiencies involved in the movement of furniture. Traditionally, when desks and other drawer equipped furniture units are being moved, either the owner or the mover will empty the contents of all drawers, pack the contents in boxes, and after the furniture reaches the new destination, the boxes must be unpacked and the contents returned to the drawers. This is time-consuming, very laborious, and counterproductive from a cost standpoint.

More specifically, it is the object of the invention to provide a simplified, lightweight, reusable stabilizing means for the contents of furniture drawers during a movement of furniture which will allow the contents to remain safely in the drawers without displacement or damage caused by manipulation of the furniture, and thus entirely eliminating the above-described contents removal, boxing and replacement procedure, as traditionally practiced. In essence, the invention will simplify and reduce the cost of moving furniture and thus is significantly beneficial to the customer and the professional mover of furniture.

The stabilizing means for furniture drawer contents is in the form of an inflatable bag to be placed in each drawer above the contents thereof in a deflated state, followed by inflation to brace and stabilize the content when the drawer is closed. The bag is deflated and removed from the drawer after the furniture reaches its destination and the contents of the drawer need not be touched before, during or after the move. The low cost, lightweight, inflatable stabilizer can be reused indefinitely. Inflation can be achieved by use of a lightweight portable pump carried by the mover.

Other objects and advantages of the invention will become apparent during the course of the following description.

DETAILED DESCRIPTION

Figure 1:
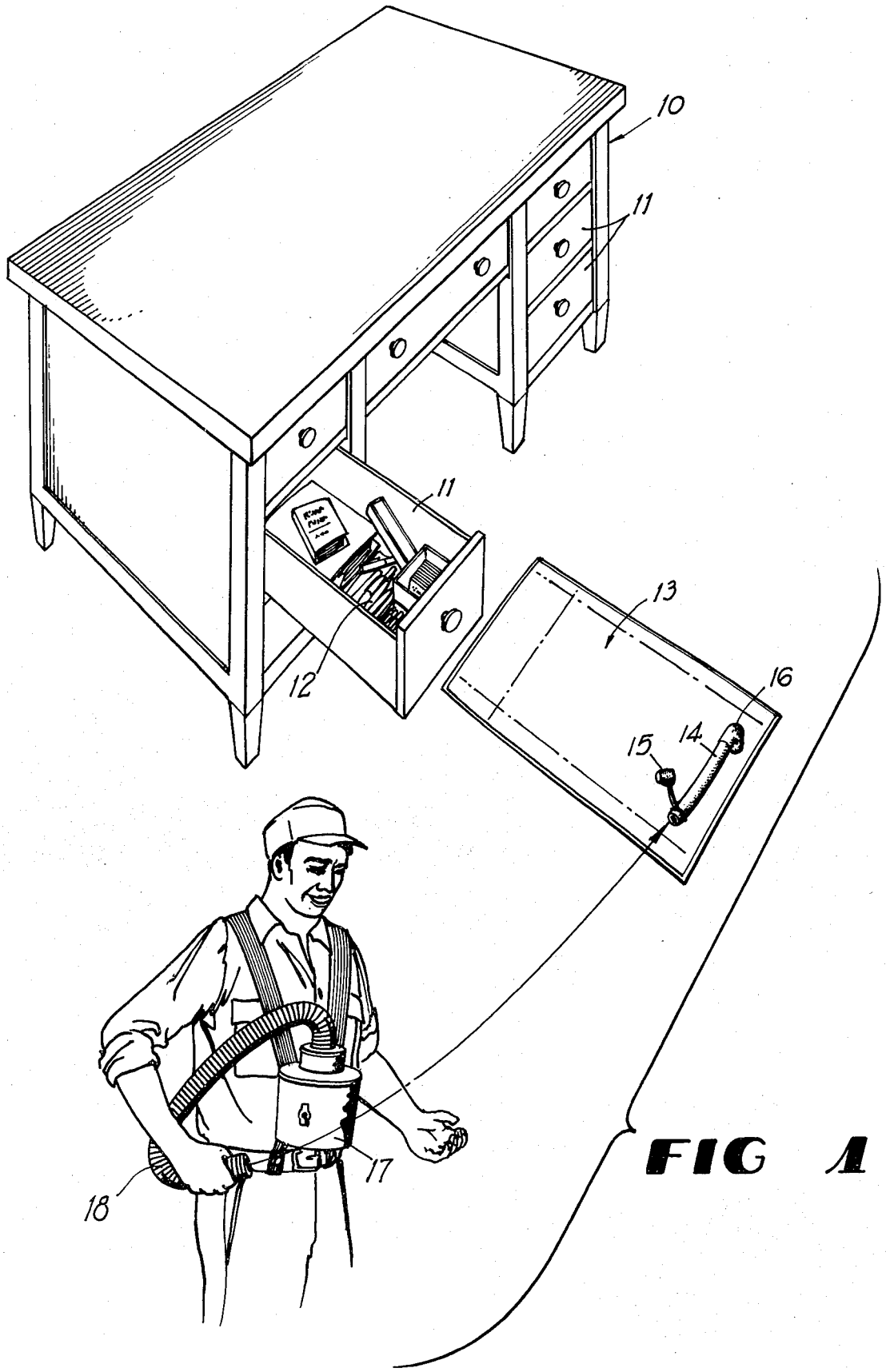
FIG. 1 is a composite perspective view of an inflatable stabilizer according to the invention shown in relation to a desk drawer and a portable pump used to inflate the stabilizer.
Figure 2:
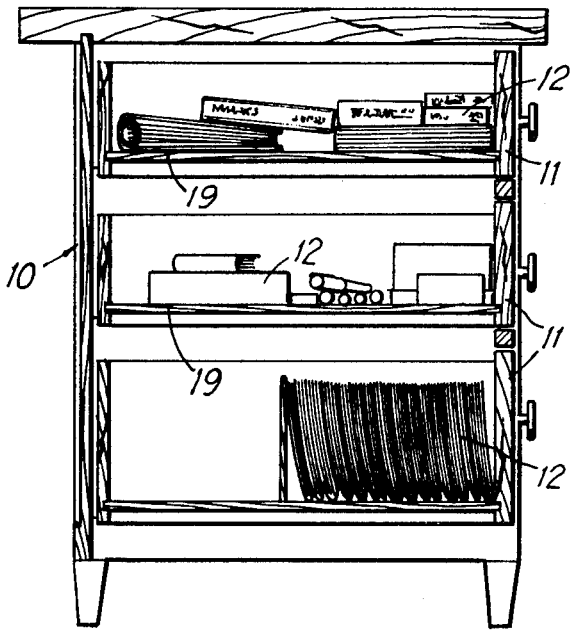
FIG. 2 is a vertical cross section through a desk whose drawers hold various contents normally without restraint.

Referring to the drawings in detail wherein like numerals designate like parts, a desk 10 includes drawers 11 having varied contents 12 therein. Such contents are customarily removed from the drawers and boxed when furniture is being moved to protect the contents from damage caused by handling of the desk in the moving process.

In accordance with the invention, as explained previously, the contents of the drawers can remain in place during movement of the furniture and the boxing of the contents and subsequent unboxing and replacement of the contents into the drawers is entirely eliminated. Instead, an inflatable contents stabilizer 13 or brace in the form of a lightweight preferably vinyl plastics bag of rectangular form is placed in each drawer 11 on top of the varied contents 12 thereof while the bag is in a deflated flat state and with the drawers at least partly open, as shown in FIG. 3.

Each inflatable bag 13 is equipped near one end with an inflating tube 14 having a tethered closure plug 15 and an elbow 16 communicating with the bag interior. In some cases, the tube 14 may be equipped with a self-closing biased check valve of the type used on tire inflation stems and some inflatable toys and the like.

For convenience, a portable lightweight inflating pump 17 having an air delivery tube 18 can be carried by a mover to deliver air under pressure to the mouth of tube 14, at proper times, to inflate the bag to the necessary degree, after which the closure plug 15 is placed in the mouth of the tube 14. Other types of inflation equipment can be used.

Figure 3:
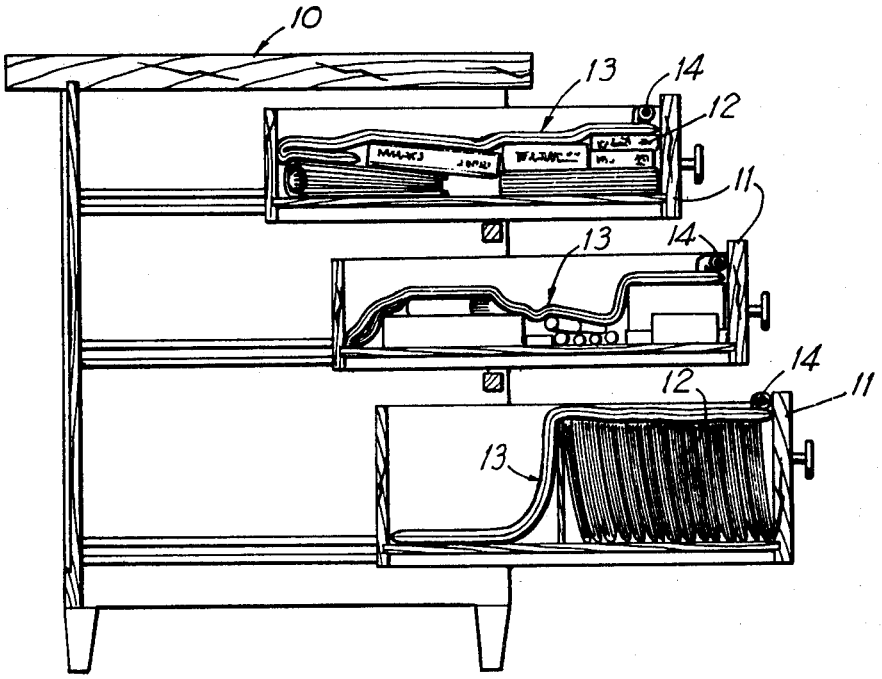
FIG. 3 is a similar view showing deflated stabilizers according to the invention placed in open drawers above their contents.
Figure 4:
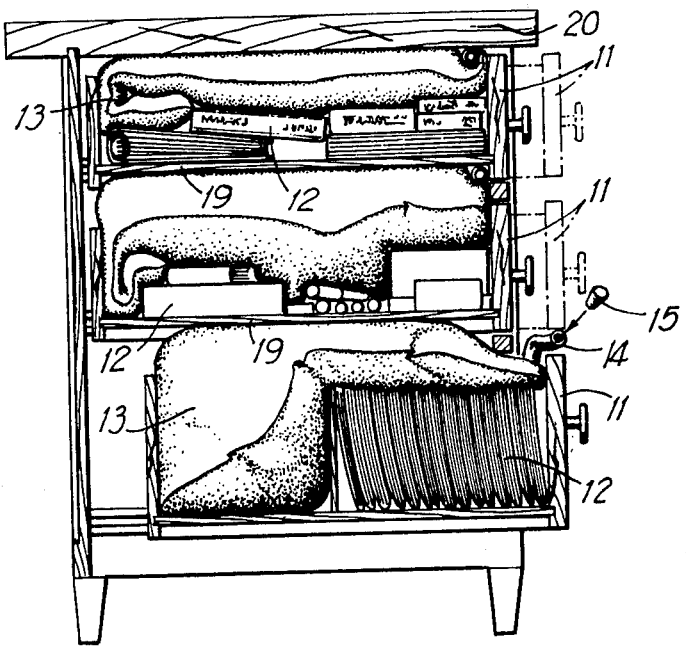
FIG. 4 is a similar view showing the stabilizers of certain drawers inflated with the drawers closed and further showing one stabilizer undergoing inflation while the drawer is still partly open.
Figure 5:
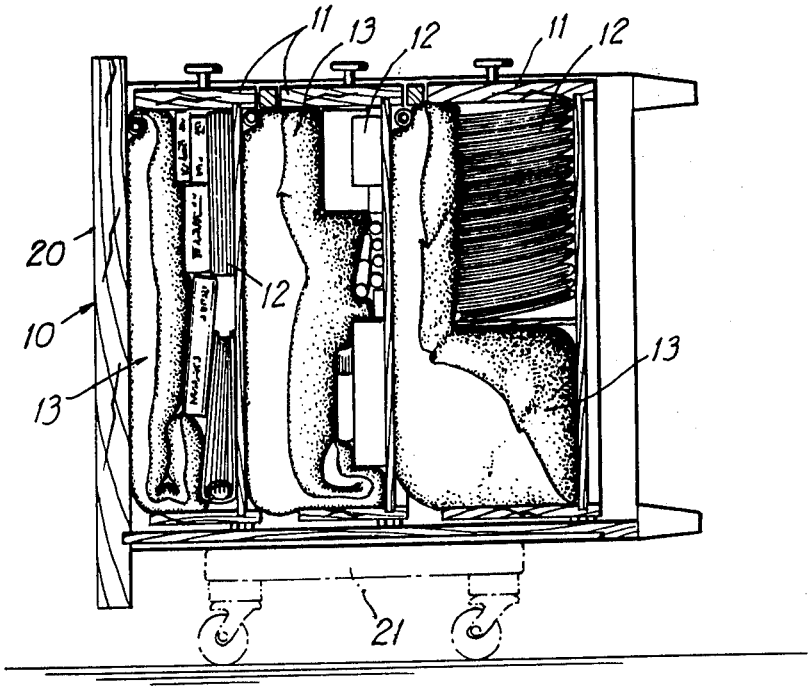
FIG. 5 is a cross sectional view of a desk being transported while resting on its rear side with the drawer contents stabilizers in place.

As shown in FIG. 3, the deflated bags 13 are placed in the drawers 11 with the inflation tubes at the fronts of the drawers and with the drawers partly closed. The air delivery tube 18 or other means is then operated to inflate the bags 13 through their tubes 14 and as the bags inflate their lower sides will assume the contours or profiles of the drawer contents 12, as shown in FIG. 4. The closure plugs 15 are placed following sufficient inflation of the bags 13, and the drawers 11 can then be fully closed, as shown in FIG. 4. The upper sides of the bags 13, when inflated, will bear against the flat bottom panels 19 of the drawers or against the desk top 20. The inflated bags exert a firm bracing or stabilizing force on the varied contents 12 preventing the same from moving and becoming damaged due to moving as the desk is being handled in the movement of furniture. For example, the desk can be upended and placed on its side on a transport dolly 21 without any movement of the contents 12 due to the bracing action afforded by the inflatable bags or stabilizers. When the desk reaches its new destination, it can be lifted and placed upright, followed by partial opening of the drawers 11, removal of the plugs 15 and deflation of the bags, whereby the latter can be removed from the drawers with the contents 12 in their original state as if the desk had not been transported.

It can be readily seen by those skilled in the art that the invention saves much time and labor and thereby increases the overall efficiency of the furniture mover. It lessens the likelihood of damage to furniture having drawers and to the contents of drawers caused by customary packing and unpacking procedures. The inflated bags have an added advantage of preventing the drawers 11 from sliding open at inopportune times during the handling of furniture. The bags prevent this due to their frictional contact with the bottoms of overlying drawers and with the immovable desk top 20.

While the invention has been shown and described in connection with a desk, it is applicable to any furniture having sliding drawers and the sizes of the bags 13 can be varied to satisfy all needs.

It is to be understood that the form of the invention herewith shown and described is to be taken as a preferred example of the same, and that various changes in the shape, size and arrangement of parts may be resorted to, without departing from the spirit of the invention or scope of the subjoined claims.

What is claimed is:

1. A method of preparing a furniture unit having drawers with contents for moving, comprising partly opening the drawers with their contents in place while the furniture unit is in a normal upright position, placing inflatable contents stabilizers on top of the contents in the drawers while the stabilizers are in a deflated state, inflating the stabilizers while the drawers are partly open to expand the stabilizers into firm pressure contact with the drawer contents and against the bottoms of adjacent uppermost drawers, and fully closing the drawers with the inflated contents stabilizers therein to enable safe movement of the furniture unit without displacement of the drawer contents.

2. The method of claim 1, and the inflatable contents stabilizers placed on top of the contents in the drawers conforming substantially to the shapes and sizes of the drawers in their normal horizontal planes.

3. The method of claim 2, and the inflating of the stabilizers being accomplished with the use of a portable inflation device having an air delivery means adapted for coupling with an inflation air inlet means of each stabilizer.

* * * * *